US008267177B1

(12) United States Patent
Vogel et al.

(10) Patent No.: US 8,267,177 B1
(45) Date of Patent: Sep. 18, 2012

(54) MEANS FOR CREATING FIELD CONFIGURABLE BRIDGE, FRACTURE OR SOLUBLE INSERT PLUGS

(75) Inventors: Jason Jon Vogel, Sandy, UT (US); Randall Williams Nish, Provo, UT (US); Randy Arthur Jones, Park City, UT (US)

(73) Assignee: Exelis Inc., McLean, VA (US)

( * ) Notice: Subject to any disclaimer, the term of this patent is extended or adjusted under 35 U.S.C. 154(b) by 335 days.

(21) Appl. No.: 12/549,652

(22) Filed: Aug. 28, 2009

Related U.S. Application Data

(63) Continuation-in-part of application No. 12/353,655, filed on Jan. 14, 2009, now Pat. No. 8,127,856.

(60) Provisional application No. 61/089,302, filed on Aug. 15, 2008, provisional application No. 61/230,345, filed on Jul. 31, 2009.

(51) Int. Cl.
*E21B 34/00* (2006.01)

(52) U.S. Cl. ..... 166/317; 166/131

(58) Field of Classification Search ..... 166/119, 166/118, 148, 138, 317, 323, 126, 131, 133, 166/142; 137/67, 68.11, 271
See application file for complete search history.

(56) References Cited

U.S. PATENT DOCUMENTS

| | | | | |
|---|---|---|---|---|
| 1,684,266 | A | | 9/1928 | Fisher et al. |
| 2,043,225 | A | | 6/1936 | Armentrout et al. |
| 2,160,804 | A | | 5/1939 | Hall et al. |
| 2,205,119 | A | | 6/1940 | Hall et al. |
| 2,230,712 | A | | 2/1941 | Bendeler et al. |
| 2,249,172 | A | | 7/1941 | Quintrell |
| 2,338,326 | A | | 1/1944 | Green |
| 2,577,068 | A | | 12/1951 | Baker |
| 2,589,506 | A | | 3/1952 | Morrisett |
| 2,672,199 | A | | 3/1954 | McKenna |
| 2,725,941 | A | | 12/1955 | Henshaw |
| 2,785,758 | A | * | 3/1957 | Baker ..... 166/212 |
| 3,021,902 | A | * | 2/1962 | Keithahn ..... 166/237 |
| 3,136,365 | A | | 6/1964 | Carter et al. |
| 3,148,731 | A | | 9/1964 | Holden |
| 3,163,225 | A | | 12/1964 | Perkins |
| 3,211,232 | A | | 10/1965 | Grimmer |
| 3,298,440 | A | | 1/1967 | Current |
| 3,306,366 | A | | 2/1967 | Muse |
| 3,314,480 | A | | 4/1967 | Scott |
| 3,420,304 | A | | 1/1969 | Kilgore |

(Continued)

OTHER PUBLICATIONS

Baker Hughes Baker Oil Tools Remedial Systems Technical Unit QUIK Drill Composite Bridge Plug and Wireline Adapter Kit PRoduct Family Nos. H40129 and H43848, Feb. 28, 2002, pp. 1-12.
Weatherford FracGuard Composite Plugs, 2004, 7 pages.
BJ Python Composite Bridge Plug, Product Information Sep. 20, 2001, 2 page.
Halliburton FAS Drill Squeeze Packers, Drillable Tools, 1999, 6 page.

(Continued)

*Primary Examiner* — Shane Bomar
*Assistant Examiner* — Kipp Wallace
(74) *Attorney, Agent, or Firm* — Thorpe North & Western LLP

(57) ABSTRACT

A plug for a pipe in an oil or gas well includes a packer, a slip ring and a cone disposable on a mandrel and pressed between an upper push sleeve and a lower anvil on the mandrel. The plug can be field configurable with a frac plug kit, a bridge plug kit and a soluble insert plug kit. A pair of concentric locking rings is disposed between the push sleeve and the mandrel with an outer annular cone with an outer conical shape tapered upwardly and inwardly.

12 Claims, 6 Drawing Sheets

U.S. PATENT DOCUMENTS 3,497,003 A 2/1970 Berryman et al.
3,506,067 A 4/1970 Lebourg
3,517,742 A 6/1970 Williams
3,831,677 A 8/1974 Mullins
3,976,133 A 8/1976 Allen
4,099,563 A 7/1978 Hutchison et al.
4,151,875 A 5/1979 Sullaway
4,285,398 A 8/1981 Zandmer et al.
4,289,200 A 9/1981 Fisher, Jr.
4,312,406 A 1/1982 McLaurin et al.
4,359,090 A 11/1982 Luke
4,397,351 A * 8/1983 Harris ..... 166/134
4,432,418 A 2/1984 Mayland
4,488,595 A 12/1984 Akkerman
4,524,825 A 6/1985 Fore
4,532,989 A 8/1985 Barker
4,542,788 A 9/1985 Semar
4,553,596 A 11/1985 Graham et al.
4,664,188 A 5/1987 Zunkel et al.
4,708,202 A 11/1987 Sukup et al.
4,730,835 A 3/1988 Wilcox et al.
4,739,829 A 4/1988 Brunner
4,745,972 A 5/1988 Bell et al.
4,784,226 A * 11/1988 Wyatt ..... 166/376
4,813,481 A 3/1989 Sproul et al.
4,834,184 A 5/1989 Streich et al.
4,858,687 A 8/1989 Watson et al.
4,926,938 A 5/1990 Lindsey, Jr.
5,086,839 A * 2/1992 Setterberg et al. ..... 166/138
5,095,978 A 3/1992 Akkerman et al.
5,131,468 A 7/1992 Lane et al.
5,188,182 A 2/1993 Echols, III et al.
5,224,540 A 7/1993 Streich et al.
5,253,709 A 10/1993 Kendrick et al.
5,271,468 A * 12/1993 Streich et al. ..... 166/387
5,333,684 A 8/1994 Walter et al.
5,340,626 A 8/1994 Head
5,390,737 A 2/1995 Jacobi et al.
5,392,856 A 2/1995 Broussard, Jr. et al.
5,404,956 A 4/1995 Bohlen et al.
5,413,172 A 5/1995 Laurel
5,422,183 A 6/1995 Sinclair et al.
5,441,111 A 8/1995 Whiteford
5,479,986 A 1/1996 Gano et al.
5,540,279 A 7/1996 Branch et al.
5,542,473 A 8/1996 Pringle et al.
5,553,667 A 9/1996 Budde et al.
5,597,784 A 1/1997 Sinclair et al.
5,607,017 A 3/1997 Owens et al.
5,613,560 A 3/1997 Jelinski et al.
5,678,635 A 10/1997 Dunlap et al.
5,701,959 A 12/1997 Hushbeck et al.
5,749,419 A 5/1998 Coronado et al.
5,765,641 A 6/1998 Shy et al.
5,787,979 A 8/1998 Giroux et al.
5,813,457 A 9/1998 Giroux et al.
5,819,846 A 10/1998 Bolt, Jr.
5,837,656 A 11/1998 Sinclair et al.
5,839,515 A 11/1998 Yuan et al.
5,904,207 A 5/1999 Rubbo et al.
5,924,696 A 7/1999 Frazier
5,941,309 A 8/1999 Appleton
5,984,007 A 11/1999 Yuan et al.
5,990,051 A 11/1999 Ischy et al.
6,009,944 A 1/2000 Gudmestad
6,026,903 A 2/2000 Shy et al.
6,056,053 A 5/2000 Giroux et al.
6,076,600 A 6/2000 Vick, Jr. et al.
6,082,451 A 7/2000 Giroux et al.
6,131,663 A 10/2000 Henley et al.
6,145,593 A 11/2000 Hennig
6,167,957 B1 1/2001 Frazier
6,167,963 B1 1/2001 McMahan et al.
6,189,618 B1 2/2001 Beeman et al.
6,220,349 B1 4/2001 Vargus et al.
6,220,350 B1 4/2001 Brothers et al.
6,244,642 B1 6/2001 Serafin et al.
6,279,656 B1 8/2001 Sinclair et al.
6,318,461 B1 11/2001 Carisella
6,318,729 B1 11/2001 Pitts, Jr. et al.
6,354,372 B1 3/2002 Carisella et al.
6,394,180 B1 5/2002 Berscheidt et al.
6,412,388 B1 7/2002 Frazier
6,431,274 B1 8/2002 Nowlin et al.
6,481,496 B1 11/2002 Jackson et al.
6,491,108 B1 12/2002 Slup et al.
6,491,116 B2 12/2002 Berscheidt et al.
6,540,033 B1 4/2003 Sullivan et al.
6,578,633 B2 6/2003 Slup et al.
6,581,681 B1 6/2003 Zimmerman et al.
6,598,672 B2 7/2003 Bell et al.
6,598,679 B2 7/2003 Robertson
6,599,863 B1 7/2003 Palmer et al.
6,651,738 B1 11/2003 Solfronk et al.
6,651,743 B2 11/2003 Szarka
6,655,459 B2 12/2003 Mackay
6,666,275 B2 12/2003 Neal et al.
6,695,050 B2 2/2004 Winslow et al.
6,695,051 B2 2/2004 Smith et al.
6,708,768 B2 3/2004 Slup et al.
6,708,770 B2 3/2004 Slup et al.
6,712,153 B2 3/2004 Turley et al.
6,732,822 B2 * 5/2004 Slack et al. ..... 175/423
6,752,209 B2 6/2004 Mondelli et al.
6,769,491 B2 8/2004 Zimmerman et al.
6,793,022 B2 9/2004 Vick et al.
6,796,376 B2 9/2004 Frazier
6,799,638 B2 10/2004 Butterfield, Jr.
6,827,150 B2 12/2004 Luke
6,976,534 B2 12/2005 Sutton et al.
6,986,390 B2 1/2006 Doane et al.
7,017,672 B2 3/2006 Owen, Sr.
7,036,602 B2 5/2006 Turley et al.
7,044,230 B2 5/2006 Starr et al.
7,049,272 B2 5/2006 Sinclair et al.
7,093,664 B2 8/2006 Todd et al.
7,124,831 B2 10/2006 Turley et al.
7,163,066 B2 1/2007 Lehr
7,168,494 B2 1/2007 Starr et al.
7,210,533 B2 5/2007 Starr et al.
7,255,178 B2 8/2007 Slup et al.
7,258,165 B1 8/2007 Williams
7,273,099 B2 9/2007 East, Jr. et al.
7,287,596 B2 10/2007 Frazier et al.
7,322,413 B2 1/2008 Rogers et al.
7,337,852 B2 3/2008 Manke et al.
7,350,582 B2 4/2008 McKeachnie et al.
7,353,879 B2 4/2008 Todd et al.
7,373,973 B2 5/2008 Smith et al.
7,380,600 B2 6/2008 Willberg et al.
7,395,856 B2 7/2008 Murray
7,452,161 B2 11/2008 Freyer et al.
7,461,699 B2 12/2008 Richard et al.
7,464,764 B2 12/2008 Xu
7,510,018 B2 3/2009 Williamson et al.
7,735,549 B1 6/2010 Nish et al.
7,743,836 B2 6/2010 Cook et al.
7,789,135 B2 9/2010 Turley et al.
7,900,696 B1 3/2011 Nish et al.
2002/0070503 A1 6/2002 Zimmerman et al.
2002/0162662 A1 11/2002 Passamaneck et al.
2003/0155112 A1 8/2003 Tiernan et al.
2003/0188862 A1 * 10/2003 Streich et al. ..... 166/250.01
2004/0003928 A1 1/2004 Frazier
2004/0036225 A1 2/2004 Ritter et al.
2004/0045723 A1 3/2004 Slup et al.
2004/0177952 A1 9/2004 Turley et al.
2005/0161224 A1 7/2005 Starr et al.
2005/0189103 A1 9/2005 Roberts et al.
2005/0205264 A1 9/2005 Starr et al.
2006/0124307 A1 6/2006 Turley et al.
2006/0131031 A1 6/2006 McKeachnie et al.
2006/0278405 A1 12/2006 Turley et al.
2007/0039160 A1 2/2007 Turley et al.
2007/0074873 A1 4/2007 McKeachnie et al.
2007/0102165 A1 5/2007 Slup et al.
2007/0119600 A1 * 5/2007 Slup et al. ..... 166/387

| | | | |
|---|---|---|---|
| 2007/0284097 | A1 | 12/2007 | Swor et al. |
| 2007/0284114 | A1 | 12/2007 | Swor et al. |
| 2008/0047717 | A1 | 2/2008 | Frazier et al. |
| 2008/0060821 | A1 | 3/2008 | Smith et al. |
| 2008/0073074 | A1 | 3/2008 | Frazier |
| 2008/0073081 | A1 | 3/2008 | Frazier et al. |
| 2008/0202764 | A1 | 8/2008 | Clayton et al. |
| 2008/0257549 | A1 | 10/2008 | Swor et al. |
| 2009/0038790 | A1 | 2/2009 | Barlow |
| 2009/0044957 | A1 | 2/2009 | Clayton et al. |
| 2009/0065194 | A1 | 3/2009 | Frazier |
| 2009/0065216 | A1 | 3/2009 | Frazier |
| 2009/0078647 | A1 | 3/2009 | Frazier et al. |
| 2009/0139720 | A1 | 6/2009 | Frazier |
| 2009/0159274 | A1 | 6/2009 | Frazier |
| 2009/0178808 | A1 | 7/2009 | Williamson et al. |
| 2010/0024703 | A1 | 2/2010 | Zampiello et al. |
| 2010/0155050 | A1 | 6/2010 | Frazier |
| 2010/0276159 | A1 | 11/2010 | Mailand et al. |
| 2010/0282004 | A1 | 11/2010 | Nance et al. |
| 2010/0288487 | A1 | 11/2010 | Turley et al. |
| 2011/0079383 | A1 | 4/2011 | Porter et al. |

OTHER PUBLICATIONS

Weatherford Completion Systems FracGuard Series Composite Frac Plug 2001, Brochure No. 432.00 & 433.00; 2 pages.

BioBalls MR, Soluble Ball Sealers, www.santrol.com, Applicant believes that the Bioballs were offered for sale prior to the filing date of applicant's application.

Nish, et al., U.S. Appl. No. 12/253,319, filed Oct. 17, 2008.

Nish, et al., U.S. Appl. No. 12/253,337, filed Oct. 17, 2008.

Nish, et al., U.S. Appl. No. 12/353,655, filed Jan. 14, 2009.

U.S. Appl. No. 13/176,107, filed Jul. 5, 2011; Randall Nish.

U.S. Appl. No. 12/353,655, filed Jan. 14, 2009; Randall Nish; office action issued Feb. 15, 2011.

U.S. Appl. No. 12/916,095, filed Oct. 29, 2010; Randall Nish.

"Composite Plugs, Magnum Oil Tools International"; 19 pages.

U.S. Appl. No. 12/353,655, filed Jan. 14, 2009; Randall W. Nish; Notice of Allowance issued Nov. 2, 2011.

U.S. Appl. No. 13/362,185, filed Jan. 31, 2012; Randall W. Nish; Office Action issued May 2, 2012.

* cited by examiner

MEANS FOR CREATING FIELD CONFIGURABLE BRIDGE, FRACTURE OR SOLUBLE INSERT PLUGS

PRIORITY CLAIM

This is a continuation-in-part of U.S. patent application Ser. No. 12/353,655, filed on Jan. 14, 2009 now U.S. Pat. No. 8,127,856, which claims priority to U.S. Provisional Application Ser. No. 61/089,302, filed Aug. 15, 2008, which are hereby incorporated herein by reference in their entirety.

Priority is claimed to copending U.S. Provisional Patent Application Ser. No. 61/230,345, filed Jul. 31, 2009, which is hereby incorporated herein by reference in its entirety.

RELATED APPLICATIONS

This is related to U.S. patent application Ser. Nos. 11/800,448; 12/353,655; 12/253,319; and 12/253,337; which are hereby incorporated herein by reference in their entirety.

BACKGROUND

1. Field of the Invention

The present invention relates generally to bridge and fracture plugs used in oil and gas wells.

2. Related Art

Just prior to beginning "production," oil and gas wells are completed using a complex process involving explosive charges and high pressure fluids. Once drilling is complete, a well is lined with steel pipe backed with cement that bridges the gap between the pipe outer diameter and rock face. The steel/cement barrier is then perforated with explosive shaped charges. High pressure fluids are then pumped down the well, through the perforations and into the rock formation to prepare the rock and well for the flow of gas and oil into the casing and up the well. Depending on numerous factors including the depth of the well, size and active "levels" in the reservoir, reservoir pressure, etc. this fracturing process is repeated several times in a given well—from a few elevations to as many as 30. As they prepare to "Frac" at each level, well technicians set a temporary plug in the bore of the steel casing pipe (just below where they will perforate) that will then allow them to pump "Frac fluids" and sand down through the perforations and into the reservoir. Use of the temporary plug prevents contaminating the already-fractured levels below. This process is repeated several times, as the Frac operation moves up the well, until all desired zones have been stimulated. At each level, the temporary plugs are usually left in place, so that they can all be drilled out at the end of the process, in a single operation.

To reduce the time needed to complete each well, is advantageous to use temporary plugs constructed primarily from soft metal alloys and composite materials (fiberglass and high performance plastics) that can be drilled out quickly, but still withstand the required pressures (up to 10,000 psi either upward or downward) and temperatures (up to 350° F.) for a period up to several weeks, in what is a very hostile environment.

One disadvantage with some prior plugs is that they must be shipped from the factory in the configuration in which they will be used in the well. For example, a frac plug allows upward flow but blocks downward flow. A bridge plug blocks flow in both directions. A soluble insert plug will temporary block flow in both directions and then reconfigure itself to allow flow in one direction. Thus, different types of plugs must be shipped to the well. Unfortunately, the well operator does not often know which plugs he wants installed at each level until he evaluates the well's response to the frac operations. Therefore, the tool hand (usually the plug supplier) and operator are unable to anticipate which mix of frac and bridge plugs will be needed with each well. This situation also creates a risk for both parties of having too many or too few of one kind or other plug causing project delays, stranded inventory and cash flow problems.

SUMMARY OF THE INVENTION

It has been recognized that it would be advantageous to develop a field-configurable bridge, fracture or soluble insert plug made primarily from metal alloys and composite materials. In addition, it has been recognized that it would be advantageous to develop a plug in which the upper portion of the mandrel (aka top mandrel) is installed via a threaded or other mechanical connection. In addition, it has been recognized that it would be advantageous to develop a plug that transfers load into the slips from the push sleeve. In addition, it has been recognized that, upon setting of the plug in the casing, it would be advantageous to retain all of the sealing system components tightly against the lower anvil, not allowing the mandrel to stroke vertically, which abrades the sealing surfaces. In addition, it has been recognized that it would be advantageous to develop a plug that fractures the top mandrel to create a feature that improves the drill out performance of the plug.

The invention provides a plug device disposable in a pipe of an oil or gas well. The plug or mandrel assembly includes a mandrel with a packer disposed thereon compressible and radially expandable to seal between the mandrel and the pipe, and with a slip ring disposed thereon radially expandable to engage the pipe, and with a cone adjacent the slip ring to radially displace the slip ring. The packer, the slip ring and the cone are pressed between an upper push sleeve and a lower anvil on the mandrel.

In accordance with one aspect of the present invention, the plug or mandrel assembly includes a pair of concentric locking rings disposed between the push sleeve and the mandrel. The pair of locking rings includes an inner threaded annular insert with teeth or threads on an inner surface engaging the mandrel and teeth or threads on an outer surface. The pair of locking rings also includes an outer annular cone with an outer conical shape tapered upwardly and inwardly, and with teeth or threads on an inner surface engaging the teeth or threads on the outer surface of the inner threaded annular insert. In addition, the outer annular cone can directly abut to the slip ring.

In accordance with another aspect of the present invention, the plug or mandrel assembly includes an inner anvil with external threads threaded into internal threads in the mandrel. An annular anvil cap with internal threads is threaded onto external threads of the inner anvil securing the anvil cap to the mandrel. The anvil cap has a greater diameter than the mandrel. The packer, the slip ring and the cone are pressed between an upper push sleeve and the anvil cap.

In accordance with another aspect of the present invention, the plug or mandrel assembly can be field configurable with one or more kits. A frac plug kit includes a frac top mandrel couplable to a top of the mandrel. A frac ball is disposed in the bore in the mandrel and between the top mandrel and the seat in the bore of the mandrel. The frac ball is sealable against the seat to resist flow downwardly through the bore. The frac ball is disposable away from the seat and towards the frac top mandrel to allow flow upwardly through the bore. A bridge plug kit includes a bridge top mandrel, different from the frac top mandrel, couplable to the top of the mandrel. A bridge insert is disposed in the bore of the mandrel between the bridge top mandrel and the seat. The bridge top mandrel holds the bridge insert against the seat to resist flow in either direction. A soluble insert kit includes the frac top mandrel couplable to the top of the mandrel. A soluble insert is disposable in the bore of the mandrel and dissolvable over a predetermined time due to fluids, temperatures or both in the well. The bridge insert is disposed in the bore of the mandrel between the soluble insert and the seat. The soluble insert initially and temporarily holds the bridge insert against the seat, resisting flow in either direction. The soluble insert subsequently dissolves to allow the bridge insert to displace away from the seat and allow flow upwardly through the bore.

In accordance with another aspect of the present invention, a top mandrel is couplable to a top of the mandrel. An annular inclined groove is formed in the top mandrel and oriented at an incline with respect to the longitudinal axis of the mandrel. The top mandrel is capable of shearing along the annular inclined groove leaving an upper end with an inclined edge.

BRIEF DESCRIPTION OF THE DRAWINGS

Additional features and advantages of the invention will be apparent from the detailed description which follows, taken in conjunction with the accompanying drawings, which together illustrate, by way of example, features of the invention; and, wherein.

Figure 1A:
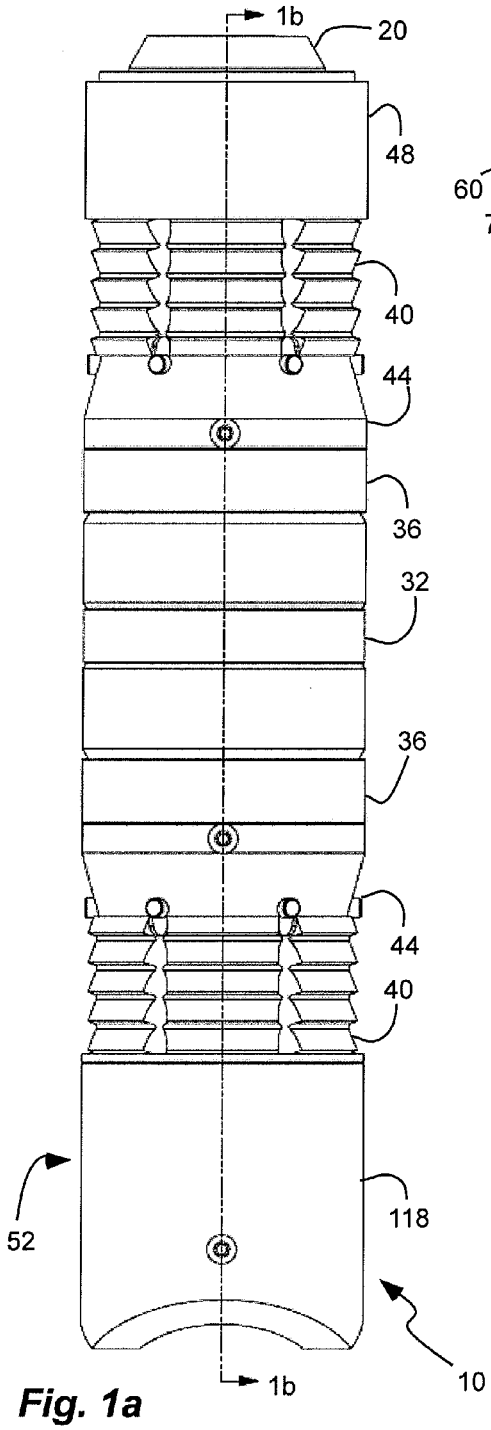
FIG. 1*a* is a front view of a plug or mandrel assembly in accordance with an embodiment of the present invention.
Figure 1B:
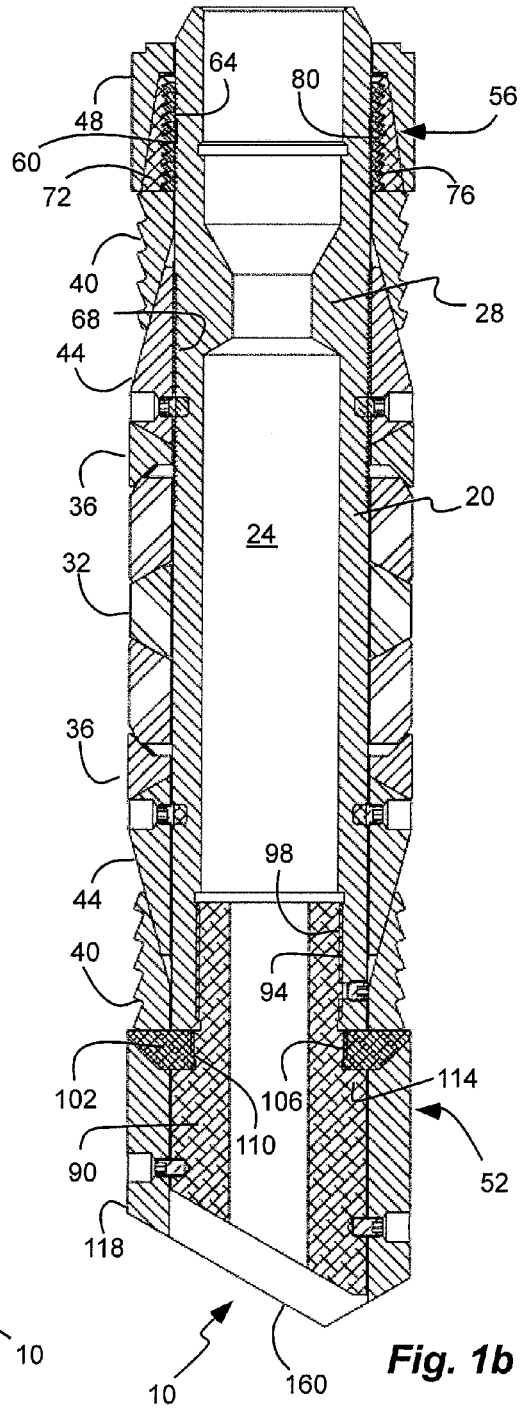
FIG. 1*b* is a cross-sectional view of the plug or mandrel assembly of FIG. 1*a* taken along line 1*b*-1*b* in FIG. 1*a;*
Figure 1C:
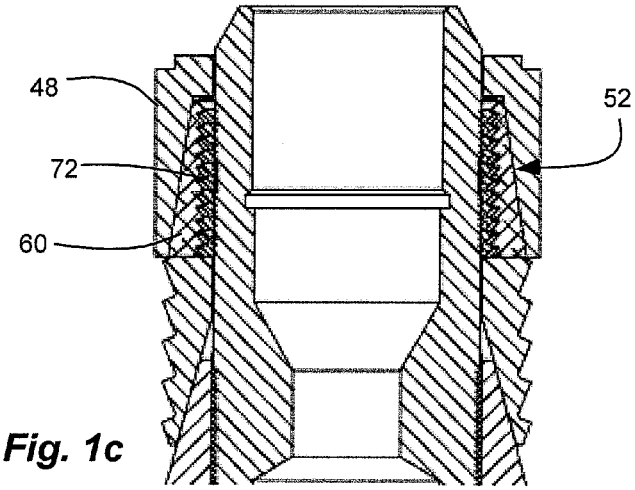
FIG. 1*c* is a detailed cross-sectional view of the push sleeve of the plug or mandrel assembly of FIG. 1*a;*
Figure 2A:
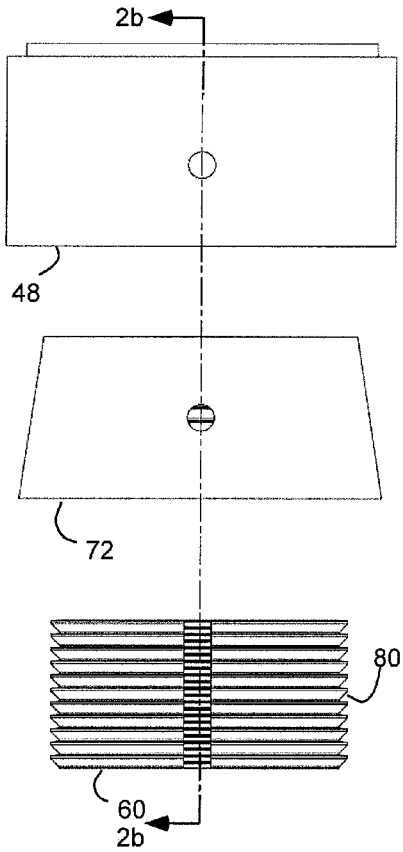
FIG. 2*a* is an exploded front view of a push sleeve and locking rings of the plug or mandrel assembly of FIG. 1*a;*
Figure 2B:
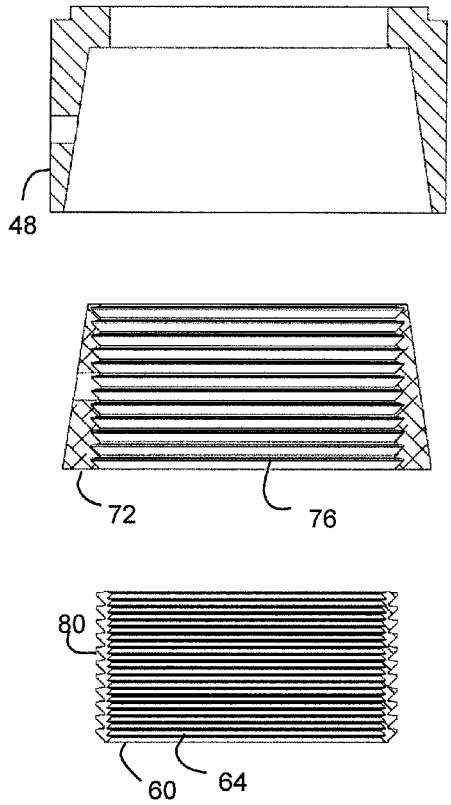
FIG. 2*b* is a cross-sectional exploded view of the push sleeve and locking rings of FIG. 2*a;*
Figure 3A:
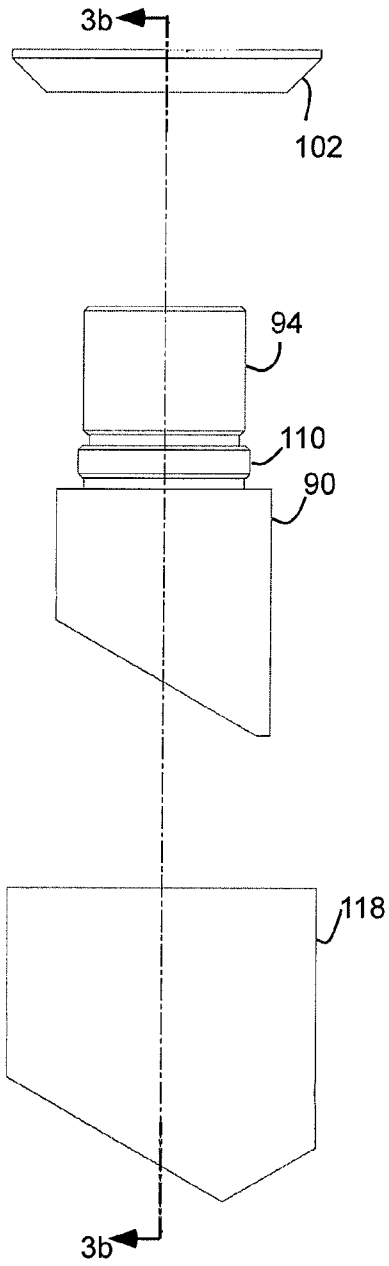
FIG. 3*a* is an exploded front view of an anvil of the plug or mandrel assembly of FIG. 1*a;*
Figure 3B:
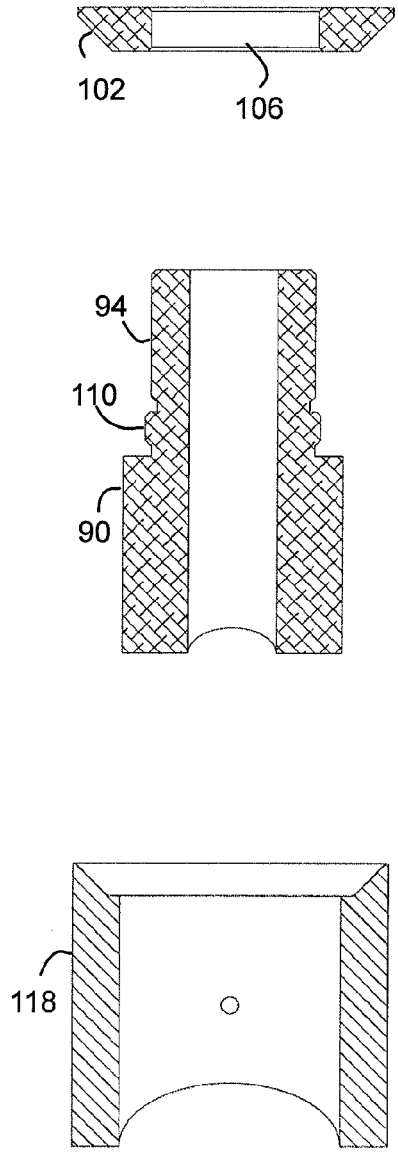
FIG. 3*b* is an cross-sectional exploded view of the anvil of FIG. 3*a;*

Reference will now be made to the exemplary embodiments illustrated, and specific language will be used herein to describe the same. It will nevertheless be understood that no limitation of the scope of the invention is thereby intended.

DETAILED DESCRIPTION OF EXAMPLE EMBODIMENT(S)

As illustrated in FIGS. 1*a*-3*b*, a plug device or mandrel assembly, indicated generally at 10, in an example implementation in accordance with the invention is shown for use in a pipe or casing of an oil or gas well. The plug 10 can be configured as a bridge plug to restrict flow in either direction (up and down), a fracture ("frac") plug to restrict flow in one direction (typically down), or a soluble insert plug that begins as a bridge plug, but then transitions to a frac plug after a predetermined time or condition in the well. Various aspects of such plugs are shown in U.S. patent application Ser. Nos. 11/800,448; 12/353,655; 12/253,319; and 12/253,337; which are herein incorporated by reference.

The plug 10 includes a center mandrel 20 that can be made of aluminum. The mandrel 10 holds various other components which allow it to be coupled to a setting tool that is lowered into the pipe of the well. Thus, the mandrel has an outer diameter less than an inner diameter of the pipe of the well. The mandrel can have a center bore 24 which can allow for the flow from the reservoir below when the plug is configured as a frac plug. In addition, the mandrel can have a seat 28 disposed in the bore 24 with a smaller diameter than an inner diameter of the bore. The seat can be formed by an internal annular flange in the bore.

One or more packers or elastomeric seals 32 are disposed on and carried by the mandrel. The packers 32 can include one or more compressible rings. Under longitudinal pressure or force, the packers compress longitudinally and expand radially to fill a space between the mandrel and the pipe of the well, thus forming a seal. In addition, one or more backing rings 36 can be disposed on opposite sides of the packers to resist longitudinal extrusion of the packers under pressure. One or more slips or slip rings 40 (such as upper and lower slip rings) are disposed on and carried by the mandrel. The slips 40 can be disposed on opposite sides of the packers. The slips 40 can have teeth on the exterior surface and can expand or fracture radially to engage and grip the pipe of the well. One or more cones 44 (such as upper and lower cones) can be disposed on and carried by the mandrel adjacent the slip rings to radially displace and fracture the slip rings as a cone and slip ring are pressed together.

Above and below these components are a push sleeve 48 and anvil or mule shoe 52 which are structural features designed to resist the hydrostatic, hydrodynamic and compression loads acting on the plug and the packers and their related hardware. Thus, the setting tool presses down on the push sleeve, which in turn presses the components against the anvil 52, causing the packers to expand radially and seal, and causing the slips to fracture, slide outward on the cones, and radially bite into the pipe or casing to secure the plug in place. Components installed in the upper end of the mandrel determine whether the plug will act as a "frac" or "bridge" plug. As described in greater detail below, the plug can be field configurable, such as by a tool hand "on site" at the well, as a bridge, frac, and/or soluble insert plug. The plug can be shipped direct to the field as described above, with an assembly of packers to seal the casing; backing rings, cones and slips on the mandrel. These components are crushed as a setting sleeve acts upon the push sleeve. The packers are forced out to seal the steel casing's ID and the compression load needed to create and maintain the seal is maintained by the slips which lock to the casing's ID. The compression loads acting on the slips are about 25,000 lbs, and must be maintained for weeks or even months at a time.

The plug has a pair of locking rings 56 disposed between the push sleeve 48 and the mandrel 20 to assist in maintaining the compression force on the packers and slip rings. An inner threaded annular insert 60 has a plurality of internal teeth or threads 64 on its interior or inner surface that can engage with a plurality of external threads or teeth 68 formed on the outer surface of the mandrel. An outer annular cone 72 is concentric with the inner threaded annular insert 60 and the push sleeve 48. The cone 72 has an outer conical shape that tapers upwardly and inwardly. Thus, as pressure or force is applied to the push sleeve in a downward direction, the cone 72 is pushed down and radially inwardly causing the teeth or threads 64 and 68 to engage and lock. In addition, the cone 72 can have a plurality of inner teeth or threads 76 that engage a plurality of external teeth or threads 80 of the inner threaded annular insert 60. The cone 72 and insert 60 can be formed of a lightweight and/or soft metal. The push sleeve can be formed of a composite, such as fiberglass. The cone 72 can be placed immediately adjacent the upper slip ring (or the upper cone) such that the upper slip ring (or the upper cone) bear directly against the base of the cone. The cone 72 takes the considerable load from the slips into the threaded insert and on to the mandrel threads. In this way, the fiberglass portion of the push sleeve can become (after setting) a cosmetic feature only.

The anvil 52 includes an inner anvil 90 attached to the interior, or center bore 24, of the mandrel 20. The inner anvil 90 can have external threads 94 threaded into internal threads 98 of the center bore 24. In addition, the anvil 52 has an anvil cap 102 secured to the inner anvil, and secured to the mandrel by the inner anvil. The anvil cap 102 can be annular and can have internal threads 106 threaded onto external threads 110 on the inner anvil. Furthermore, the inner anvil 90 can have a shoulder 114 with a greater diameter than a portion of the inner anvil disposed in the center bore 24 of the mandrel. The anvil cap 102 can abut to the shoulder 114. The anvil cap can be disposed between the shoulder and an end of the mandrel. The anvil cap has a greater diameter than the mandrel so that the packers, the slip rings and the cones can be pressed between the upper push sleeve 48 and the anvil cap 102. The lower slip ring can directly abut to the anvil cap. Force applied by the components to the anvil cap is transferred to the inner anvil and to the inner surface of the mandrel. The anvil cap takes the load from the slips and transfers it by two threaded connections into the base of the mandrel. An outer anvil 118 can be disposed on the inner anvil 90 and adjacent the anvil cap 102. The outer anvil can be formed of fiberglass and can become a merely cosmetic feature after the plug is set.

The plug 10 allows a field hand to travel to an oil or natural gas well with several plugs or mandrel assemblies, as described above, and a variety of kits that allow the field hand to configure the plugs as a frac plug, a bridge plug or a soluble insert plug quickly and easily. Thus, the plug can be a field configurable plug with a mandrel assembly and one or more kits.

Figure 4A:
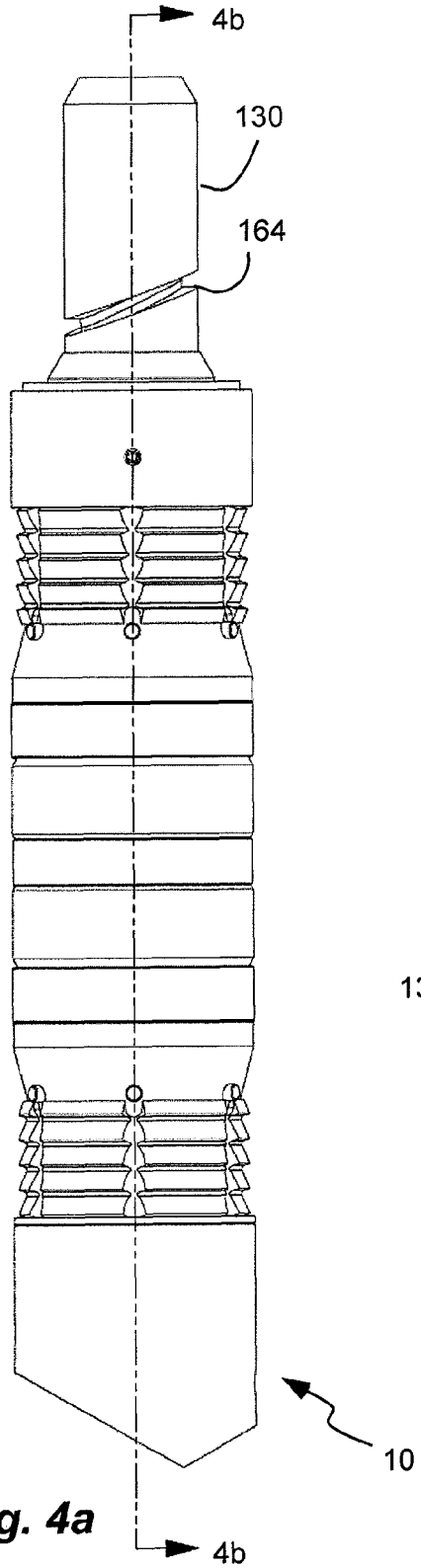
FIG. 4*a* is a front view of the plug or mandrel assembly of FIG. 1*a* configured as a fracture ("frac") plug.
Figure 4C:
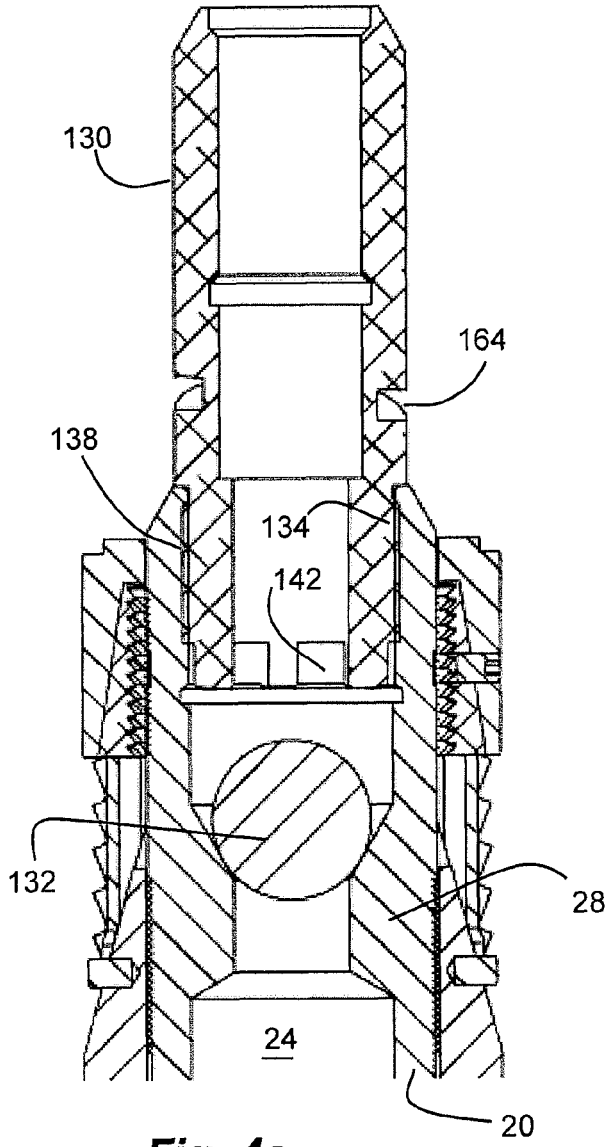
FIG. 4*c* is a detailed cross-sectional view of the upper portion of the frac plug of FIG. 4*a;*
Figure 4B:
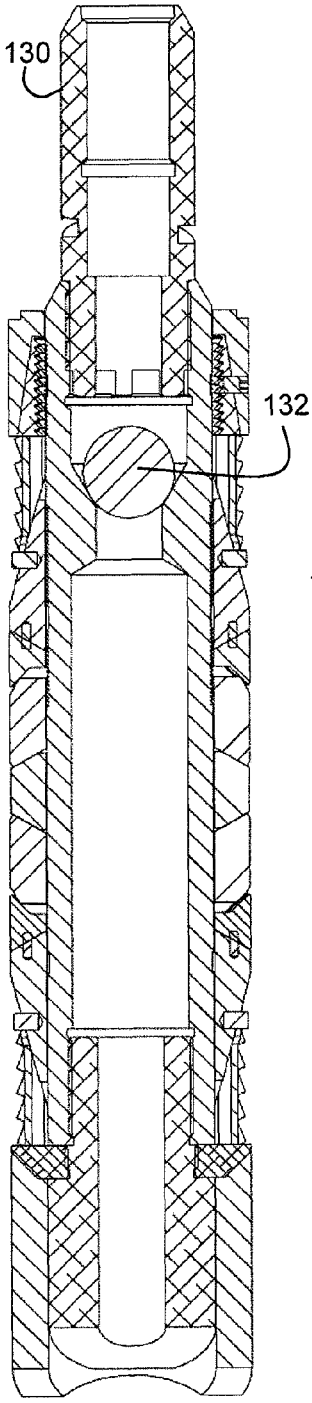
FIG. 4*b* is a cross-sectional view of the frac plug of FIG. 4*a;*

Referring to FIGS. 4*a-c*, the frac plug kit can convert the mandrel assembly described above to fracture ("frac") plug that allows flow in one direction, such as upwardly, and resists flow in the other direction, such as downwardly. The frac plug kit can include a frac top mandrel 130 and a frac ball 132. The frac top mandrel 130 can have external threads 134 threadable into internal threads 138 in the center bore 24 of the mandrel 20 to couple the frac top mandrel to the mandrel. The frac ball 132 can be disposed in the center bore 24 of the mandrel 20 between the frac top mandrel 130 and the seat 28 in the center bore. The frac ball 132 can seat and seal against the seat 28 to resist flow downwardly through the bore. In addition, the frac ball 132 can displace away from the seat, and against a bottom of the frac top mandrel 130, to allow flow upwardly through the bore. One or more holes or grooves 142 can be formed in the frac top mandrel 130, such as around a lower periphery thereof, to allow flow around the frac ball 132. In addition, the frac top mandrel can have a central bore like the mandrel to allow flow. If a frac plug is needed, the tool hand simply removes the top mandrel and frac ball from the kit, and inserts the frac ball into a top of the mandrel assembly and screws the top mandrel into the threaded connection. The frac ball can be phenolic or of many other materials including plastic, metallic or ceramic.

Figure 5A:
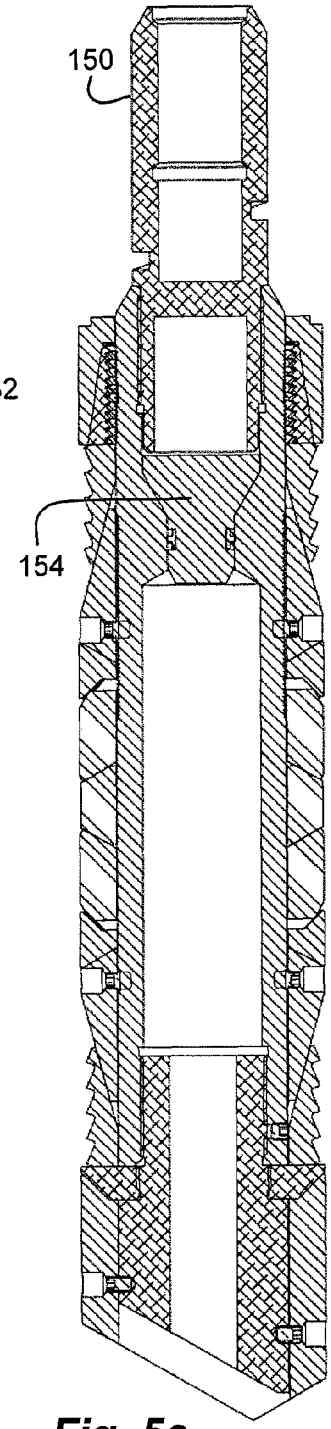
FIG. 5*a* is a cross-sectional view of the plug or mandrel assembly of FIG. 1*a* configured as a bridge plug.
Figure 5B:
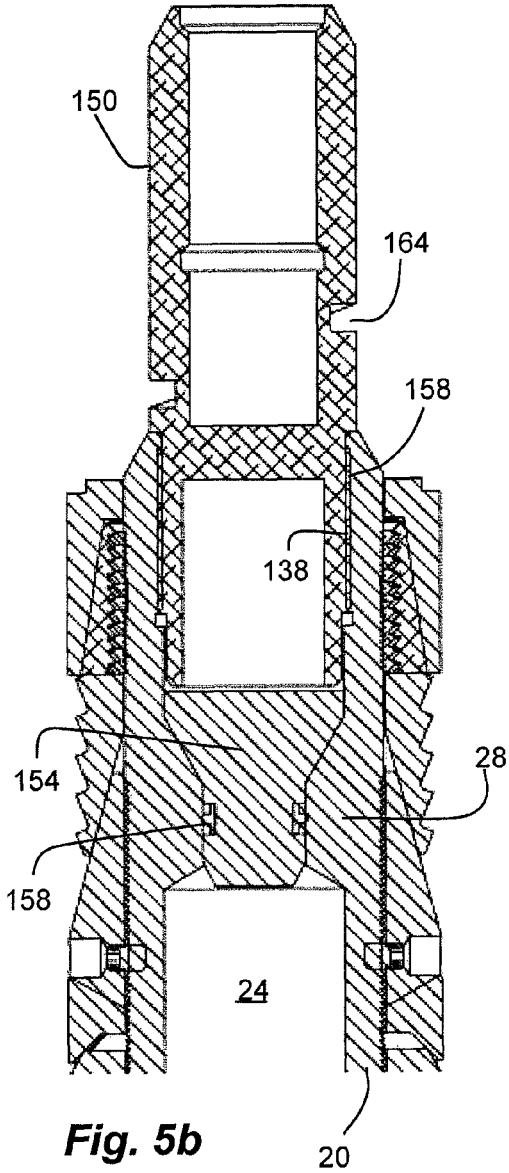
FIG. 5*b* is a detailed cross-sectional view of the bridge plug of FIG. 5*a;*

Referring to FIGS. 5*a* and 5*b*, the bridge plug kit can convert the mandrel assembly described above to a bridge plug that resists flow through the plug in either direction. The bridge plug kit can includes a bridge top mandrel 150 and a bridge insert 154. Like the frac top mandrel 130 described above, the bridge top mandrel 150 can have external threads 158 threadable into the internal threads 138 in the center bore 24 of the mandrel 20 to coupled the bridge top mandrel to the mandrel. The bridge top mandrel 150 can be different from the frac top mandrel 130, such as by being longer since the bridge top plug does not need to provide space for movement of the frac ball. The bridge insert 154 can be disposed in the center bore 24 of the mandrel 20 between the bridge top mandrel 150 and the seat 28 in the center bore. The bridge insert 154 can seat and seal against the seat 28 to resist flow through the bore. The bridge top mandrel 150 can bear against the bridge insert 154 to hold the bridge insert against the seat. The bridge insert 154 can also have a T-seal or "O" ring 158 to form a seal against the center bore or seat. If a bridge plug is needed, the tool hand removes the bridge top mandrel and bridge insert assembly from the kit. The tool hand can place grease on the T-seal, press the bridge insert into the mandrel assembly and screw the bridge top mandrel into the threaded connection.

Figure 6A:
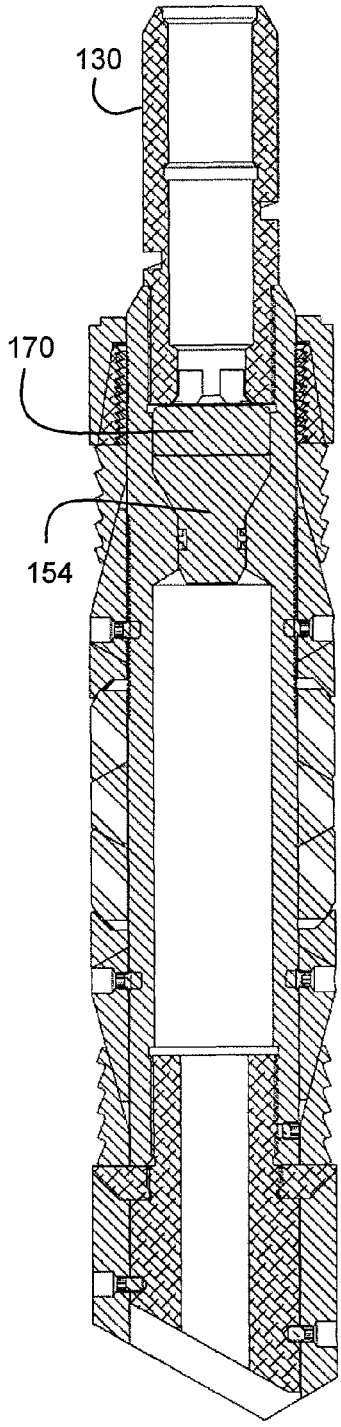
FIG. 6*a* is a cross-sectional view of the plug or mandrel assembly of FIG. 1*a* configured as a soluble insert plug.
Figure 6B:
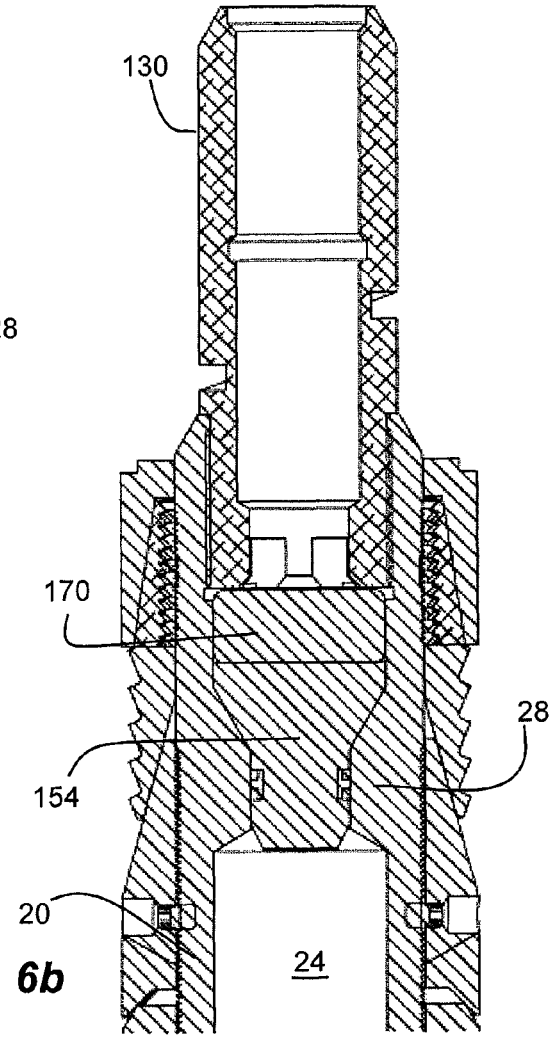
FIG. 6*b* is a detailed cross-sectional view of the soluble insert plug of FIG. 6*a;*

Referring to FIGS. 6*a* and 6*b*, the soluble insert plug kit can convert the mandrel assembly described above to an initial bridge plug and subsequently converts to a frac plug. The soluble insert plug kit includes the frac top mandrel 130, as described above from the frac plug kit, a soluble insert 170, and the bridge insert 154, as described above with respect to the bridge plug kit. The soluble insert kit uses the same frac top mandrel as the frac plug and the same bridge insert as the bridge plug. The soluble insert 170, however, is positioned in a gap between the frac top mandrel and the bridge plug. The soluble insert 170 can be a soluble disk that is dissolvable over a predetermined time due to fluids, temperatures or both in the well. The frac top mandrel 130 bears against the soluble insert 170 which bears against the bridge insert 154 to hold the bridge insert 154 against the seat to seal the central bore. Thus, the soluble insert initially and temporarily holds the bridge insert against the seat to resist flow in either direction. After the soluble insert has dissolved, the bridge insert can be pushed out of the center bore which allows fluid and/or gas to flow upward, similar to a frac plug. Thus, the soluble insert subsequently dissolves to allow the bridge insert to displace away from the seat and allow flow upwardly through the center bore.

The kits described above can also include instruction sheets and a safety spring. The frac or bridge top mandrel is attached to a setting tool as is known in the art.

When a well is ready to be completed, the plugs set during the fracture operations need to be drilled out in order to install rigid or coiled tubing all the way to the bottom of the well. This tubing assists extraction of the fluid or gas similar to the way a straw makes it easier to drink from a glass at a controlled rate. When a plug is drilled out, the drill bit consumes the top portion of the plug until it reaches the slips and packers. Once the slips are removed, the compression load on the packers is removed and the bottom half of the plug can fall down the hole until it lands on the plug below. The plug of the present invention includes an angled anvil, or an angled surface 160 (FIG. 1*b*) on the anvil, and a top mandrel 130 or 150 with an annular inclined groove 164 defining a fracture region where an upper portion above the groove can shear off after the tool is set, leaving an inclined edge of the lower end of the top mandrel. Another plug disposed above can fall on top of the plug, with the inclined edge 160 of the anvil abutting to the upper inclined edge of the plug to resist relative rotation while the top plug is drilled out. The top mandrel can be designed to fracture at 25,000 lbs tension. The fracture surface can be machined at an angle into the mandrel. When the fracture occurs, it leaves behind an angled surface designed to lock up with the bottom face of the inner mandrel from the plug above. If these two features didn't "lock up" then the loose remnants of the plug above would simply spin and drill out would be more difficult or impossible.

The term threads or threaded as used herein refers to screw threads.

While the forgoing examples are illustrative of the principles of the present invention in one or more particular applications, it will be apparent to those of ordinary skill in the art that numerous modifications in form, usage and details of implementation can be made without the exercise of inventive faculty, and without departing from the principles and concepts of the invention. Accordingly, it is not intended that the invention be limited, except as by the claims set forth below.

The invention claimed is:

1. A field-configurable plug device disposable in a pipe of an oil or gas well, comprising:

a) a mandrel with a bore and a seat formed therein, and with an elastomeric seal disposed thereon compressible and radially expandable to seal between the mandrel and the pipe, and with a slip ring disposed thereon radially expandable to engage the pipe, and with a cone adjacent the slip ring to radially displace the slip ring, and the elastomeric seal, the slip ring and the cone being pressed between an upper push sleeve and a lower anvil on the mandrel;

b) a plurality of kits, including:

i) a frac plug kit, comprising:

a frac top mandrel couplable to a top of the mandrel;

a frac ball disposed in the bore in the mandrel and between the top mandrel and the seat in the bore of the mandrel, the frac ball sealable against the seat to resist flow downwardly through the bore, and the frac ball disposable away from the seat and towards the frac top mandrel to allow flow upwardly through the bore;

ii) a bridge plug kit, comprising:

a bridge top mandrel, different from the frac top mandrel, couplable to the top of the mandrel;

a bridge insert disposed in the bore of the mandrel between the bridge top mandrel and the seat, the bridge top mandrel holding the bridge insert against the seat to resist flow in either direction; and iii) a soluble insert plug kit, comprising:

the frac top mandrel couplable to the top of the mandrel;

a soluble insert disposable in the bore of the mandrel and dissolvable over a predetermined time due to fluids, temperatures or both in the well; and the bridge insert disposed in the bore of the mandrel between the soluble insert and the seat, the soluble insert initially and temporarily holding the bridge insert against the seat resisting flow in either direction, and the soluble insert subsequently dissolving to allow the bridge insert to displace away from the seat and allow flow upwardly through the bore.

2. A device in accordance with claim 1, wherein the bridge top mandrel is longer than the frac top mandrel.

3. A device in accordance with claim 1, wherein the bridge top mandrel bears against the bridge insert and wherein the bridge insert seals against the seat of the mandrel.

4. A device in accordance with claim 1, wherein the frac top mandrel leaves a space between the frac top mandrel and the seat to accommodate movement of the frac ball.

5. A device in accordance with claim 1, wherein the frac top mandrel has one or more holes or grooves around a lower periphery thereof.

6. A device in accordance with claim 1, wherein the frac top mandrel bears against the soluble insert which bears against the bridge insert to hold the bridge insert against the seat of the mandrel to seal the central bore.

7. A device in accordance with claim 1, further comprising:

a) a pair of concentric locking rings disposed between the push sleeve and the mandrel, including an inner threaded annular insert with teeth or threads on an inner surface engaging the mandrel and teeth or threads on an outer surface, and including an outer annular cone with an annular conical shape tapered upwardly and inwardly and with teeth or threads on an inner surface engaging the teeth or threads on the outer surface of the inner threaded annular insert; and b) the outer annular cone directly abutting to the slip ring.

8. A device in accordance with claim 1, wherein the lower anvil further comprises:

a) an inner anvil with external threads threaded into internal threads in the mandrel; and b) an annular anvil cap with internal threads threaded onto external threads of the inner anvil securing the anvil cap to the mandrel, the anvil cap having a greater diameter than the mandrel, the elastomeric seal, slip rings and cones being pressed between the upper push sleeve and the anvil cap.

9. A device in accordance with claim 1, further comprising:

a) a top mandrel couplable to a top of the mandrel; and b) an annular inclined groove formed in the top mandrel and oriented at an incline with respect to a longitudinal axis of the mandrel, the top mandrel being capable of shearing along the annular inclined groove leaving an upper end with an inclined edge.

10. A field-configurable plug device disposable in a pipe of an oil or gas well, comprising:

a) a mandrel with a bore and a seat formed therein, and with an elastomeric seal disposed thereon compressible and radially expandable to seal between the mandrel and the pipe, and with a slip ring disposed thereon radially expandable to engage the pipe, and with a cone adjacent the slip ring to radially displace the slip ring, and the elastomeric seal, the slip ring and the cone being pressed between an upper push sleeve and a lower anvil on the mandrel;

b) a plurality of kits, including:

i) a frac plug kit, comprising:

a frac top mandrel couplable to a top of the mandrel;

a frac ball disposed in the bore in the mandrel and between the top mandrel and the seat in the bore of the mandrel, the frac ball sealable against the seat to resist flow downwardly through the bore, and the frac top mandrel leaving a space between the frac top mandrel and the seat of the mandrel to accommodate the frac ball moving away from the seat and towards the frac top mandrel to allow flow upwardly through the bore;

ii) a bridge plug kit, comprising:

a bridge top mandrel, different from the frac top mandrel, couplable to the top of the mandrel;

a bridge insert disposed in the bore of the mandrel between the bridge top mandrel and the seat, the bridge top mandrel bears against the bridge insert to hold the bridge insert against the seat to resist flow in either direction; and iii) a soluble insert plug kit, comprising:

the frac top mandrel couplable to the top of the mandrel;

a soluble insert disposable in the bore of the mandrel and dissolvable over a predetermined time due to fluids, temperatures or both in the well; and the bridge insert disposed in the bore of the mandrel between the soluble insert and the seat, the frac top mandrel bearing against the soluble insert which bears against the bridge insert to hold the bridge insert against the seat of the mandrel to seal the central bore resisting flow in either direction, and the soluble insert subsequently dissolving to allow the bridge insert to displace away from the seat and allow flow upwardly through the bore.

11. A device in accordance with claim 10, wherein the bridge top mandrel is longer than the frac top mandrel.

12. A device in accordance with claim 10, wherein the frac top mandrel has one or more holes or grooves around a lower periphery thereof.

* * * * *